US008302772B2

(12) United States Patent
Chang

(10) Patent No.: US 8,302,772 B2
(45) Date of Patent: Nov. 6, 2012

(54) SECURE HANGING STRUCTURE OF TOOL CASE

(76) Inventor: Chi-Tsai Chang, Taichung (TW)

( * ) Notice: Subject to any disclaimer, the term of this patent is extended or adjusted under 35 U.S.C. 154(b) by 117 days.

(21) Appl. No.: 13/022,636

(22) Filed: Feb. 8, 2011

(65) Prior Publication Data

US 2011/0192746 A1 Aug. 11, 2011

(30) Foreign Application Priority Data

Feb. 11, 2010 (TW) ..... 99203040 U

(51) Int. Cl.
*B65D 85/28* (2006.01)

(52) U.S. Cl. ..... 206/379; 220/324; 220/265

(58) Field of Classification Search ..... 206/379, 206/207, 1.8, 1.9, 279, 349, 376, 377, 378, 206/1.5; 220/203.8, 281, 324, 200, 224, 220/225, 284, 285, 265, 267, 286, 786; 215/216
See application file for complete search history.

(56) References Cited

U.S. PATENT DOCUMENTS

| | | | | |
|---|---|---|---|---|
| 3,023,925 | A * | 3/1962 | Sher | 220/786 |
| 5,979,649 | A * | 11/1999 | Rosler | 206/379 |
| 8,002,112 | B2 * | 8/2011 | Weaver et al. | 206/349 |
| 2003/0029756 | A1 * | 2/2003 | Vasudeva et al. | 206/379 |
| 2004/0031807 | A1 * | 2/2004 | Chou | 220/786 |
| 2007/0138043 | A1 * | 6/2007 | Roesler | 206/379 |

* cited by examiner

*Primary Examiner* — Mickey Yu
*Assistant Examiner* — Rafael Ortiz
(74) *Attorney, Agent, or Firm* — Leong C. Lei

(57) ABSTRACT

A secure hanging structure is provided for a tool case and includes a cap like cover board member, of which a cover inside surface forms projecting retention pawls at locations corresponding to recesses defined in an open rim of a package case and positioning tabs that protects the case against deformation and thus disengagement caused by depression, whereby the cover board member is positionable to close the enclosure opening rim of the case and realize the function of secure retaining engagement for suspension and hanging. At the connection of the positioning plate of one side to the cover board member, an open slot is defined and a fixing framing bar is provided above the slot opening, whereby after cutting of the framing bar, the positioning plate is allowed to move for opening the cover board member.

7 Claims, 5 Drawing Sheets

SECURE HANGING STRUCTURE OF TOOL CASE

TECHNICAL FIELD OF THE INVENTION

The present invention generally relates to a secure hanging structure of tool case, which mainly comprises a cap like cover board member, wherein according to retention engagement recesses formed in edges of enclosure opening of a package case, an enclosure inside surface of the cover board member forms projecting retention pawls at corresponding positions and positioning plates, which are parallel to and spaced from wall surfaces of side walls of the enclosure member, for cooperating with the retention pawls to form a retained positioning assembly with the tool case so as to ensure secure retention of the cover board member after enclosed and thus achieve secure hanging and use, surrounded open slot being pre-formed in surfaces of the cover board around the positioning plates, the slot being provided with connected enclosing bar for enclosing and fixing the positioning plate in such a way to allow for easy cutting off to allow the positioning plate to be moved for releasing the retaining engagement and achieving the purposes of secure suspension of package case.

DESCRIPTION OF THE PRIOR ART

To allow consumers to conduct visual inspection in purchasing tools, the tools are often provided with a hanging or suspending package. For sale packages for small or tiny parts or accessories, they are often enclosed or housed in a package case, and for secure suspension, it often arranges an anti-theft secure design on a cover board of the package case to meet the needs for secure suspension of the package and also to realize secure use for displaying and exhibition for sales purposes. For an anti-theft secure arrangement for small tools, such as the tools of screwdrivers or drill bits, various arrangements have been proposed in published documents. The present inventor has also received several patents issued in this respect. However, the conventional designs are generally provided for the purposes of hanging or suspending an independent or single small part or tool, which is realized by using a straight bar like element. Various forms of packages are available from a conventional form of being completely enclosed in a hollow shell package to a recently developed arrangement of suspension member that uses a fastening piece or a fastening plate to realize the purposes of anti-theft. All these know forms have their own practical uses. The conventional designs are generally provided for suspending or hanging tools of regular diameters. For suspension of a drill bit, due to the small diameter of the bit, it is uneconomic to provide a suspension package for a single bit, so that it is a common practice to enclose and suspend a set of multiple bits with a hollow shell. For tools having structures of great diameters, since the conventional fit-to-retain members for suspension purposes must be provided with various sizes of selection, the consideration of costs for economic mass production makes the packaging of articles of such as straight bar like drill bit or specific flat tool of great diameter or variable diameter not economically proper for economic need of making a mold. This becomes a trouble problem for practical packaging. Since it requires making a mold for shaping and bonding of a hollow shell, packaging that is not of mass production is not economic. Thus, a transparent case or container like package case is used as a new mode of packaging. However; it is often disposed and lines up for sale exhibition and is difficult to use in a suspending fashion, and this is because it is difficult to do anti-theft secure packaging, especially the rim of an opening to be closed requiring stapling for sewing for securing purposes. Apparently, packaging for such a known arrangement is inconvenient and the use in a suspended fashion does not meet the need for security and easiness, particularly for such a use that the surface of tool is not damaged and at the same time the desired anti-theft security can be realized, where a completely enclosed hollow shell based package is the most commonly adopted solution. However, this prevents a user to directly inspect the tool and thus makes it not meet the need of inspection for purchase. Another solution for similar purpose is also known from other publications for hanging a screwdriver, such as US Patent Publication No. US2004/0256262A1, which provides a package and suspension member, which has a bottom forming a projecting retention frame and an interior space communicating a back board to work with two fastener strips to directly loop and secure a bottom neck of a screwdriver socket to realize looped positioning. This provides a similar design for looped positioning of a tool neck in order to realize security and prevention of separation and undesired falling. However, such a structure is apparently impractical. First of all, packing is inconvenient. It is also hard to provide full protection for the suspended product may get impacted and thus damaged. Especially, the looping strips are exposed outside and this makes it easy to be cut off or subjected to abrasion, leading to breaking of the strip, which allows the suspended product to unexpectedly separate from where it is originally positioned. This generally does not meet the needs for practical use. Thus, using a complete transparent package case for suspension exhibition is the best solution for package and suspension of a small or special tool accessory. It is desired to have a further improvement that provides an anti-theft structure to an existing package case for secure suspension purposes and to ensure security of suspension exhibition of a packaged product.

SUMMARY OF THE INVENTION

In view of the problem that the existing box like package and suspension structure does not meet the need for packaging and hanging special tools and small parts and accessories, the present invention aims to provide a secure hanging structure for tool case, which comprises a cap like cover board member, of which a cover inside surface forms, on two opposite side faces thereof projecting retention pawls and positioning plates that are arranged in a projecting fashion to collectively retain an opening rim of a package case so as to achieve the purposes of anti-theft and resisting against undesired detachment. With formation of open slots along circumferences of the positioning plates and arrangement of connecting framing bar fixed thereto, the positioning plates are allowed to move after cutting off the framing bars so as to ease removal of the cover board member, and thus realizing secure packaging and hanging of small or special tools and improving the drawbacks in associated with practicability of the conventional suspension structures.

The primary objective of the present invention is to use a cap like hanging cover board member, which cooperates with recess or holes that are formed in an opening rim of a package case for fitting engagement to allow retention pawls and positioning tabs that are formed, in an opposing manner, on an inside surface of the cover board member to receive and retain and position the opening rim so as to achieve the assembling purposes of secure enclosure. This is also provided for use in combination with open slot formed in the top surface of cover around the positioning plate and the arrangement of fixing framing bars so that by cutting of the framing bars, the positioning plates are allowed to move for realizing easy disengagement and facilitating removal of the cover board member for retrieving the packaged product, whereby the package case, with the hanging plate so assembled thereto, provides a use of secure hanging and also, with the arrangement of open slot formed at two sides of the opposite side portion of the cover board member and fixing framing bars, the cover board member is allowed to do lifting operation after the fixing framing bars provided on the side faces are cut off to thereby realize a practical function and purpose of closing of the package case for storage and secure suspension.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
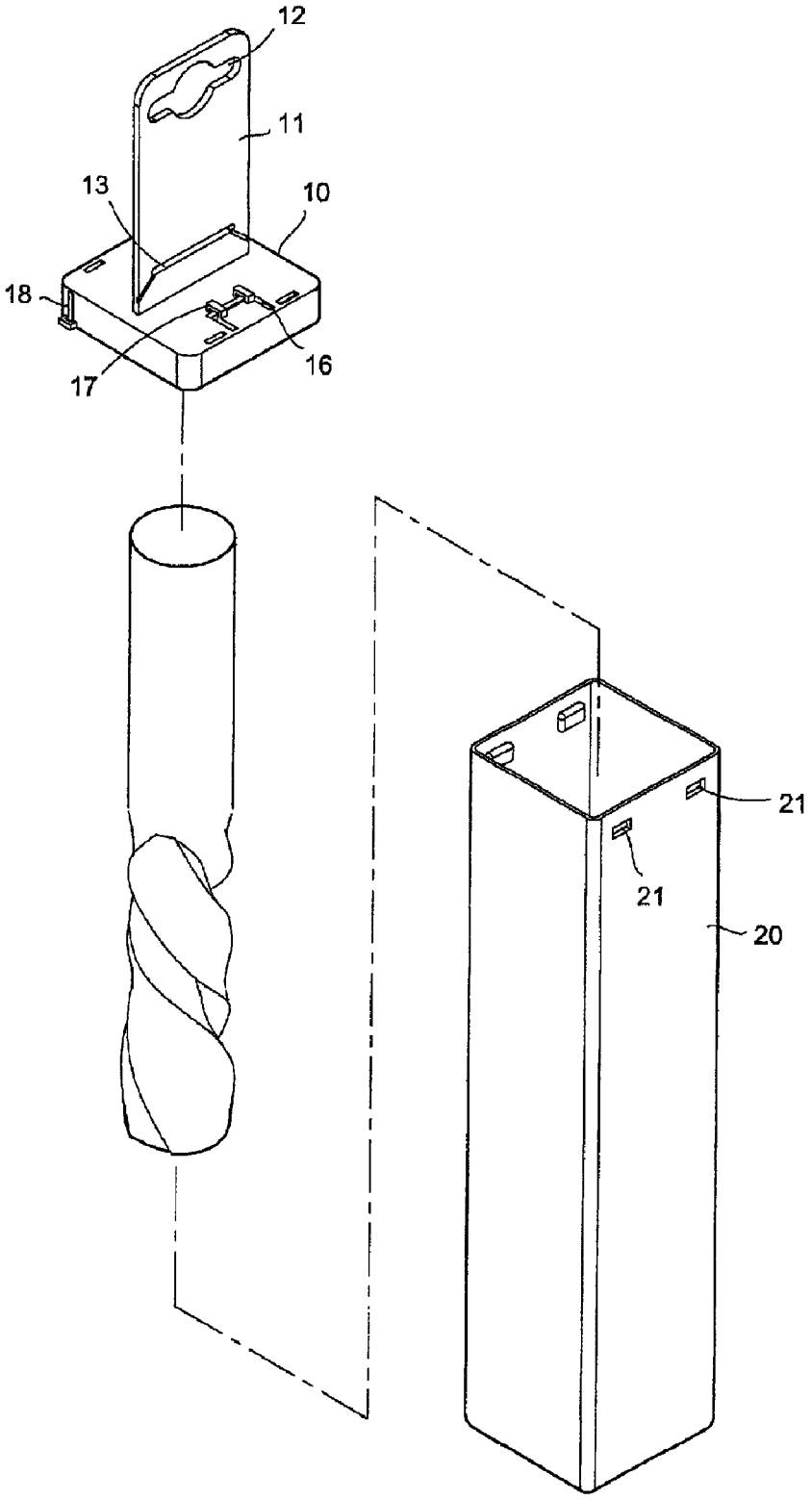
FIG. 1 is an exploded view demonstrating a hanging assembly of a package case according to the present invention.
Figure 2:
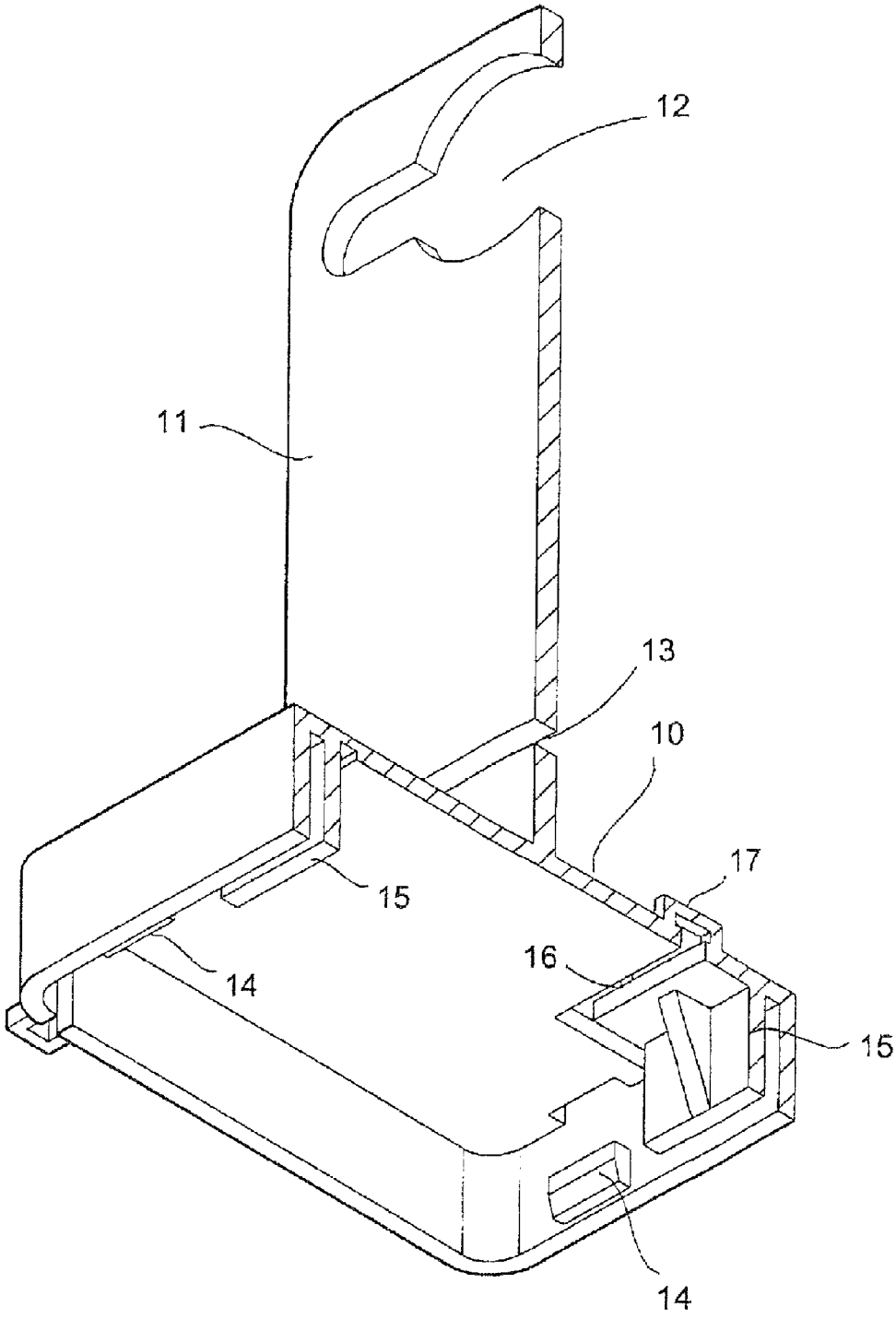
FIG. 2 is perspective view, in sectioned form, of a hanging cover board member according to the present invention.
Figure 3:
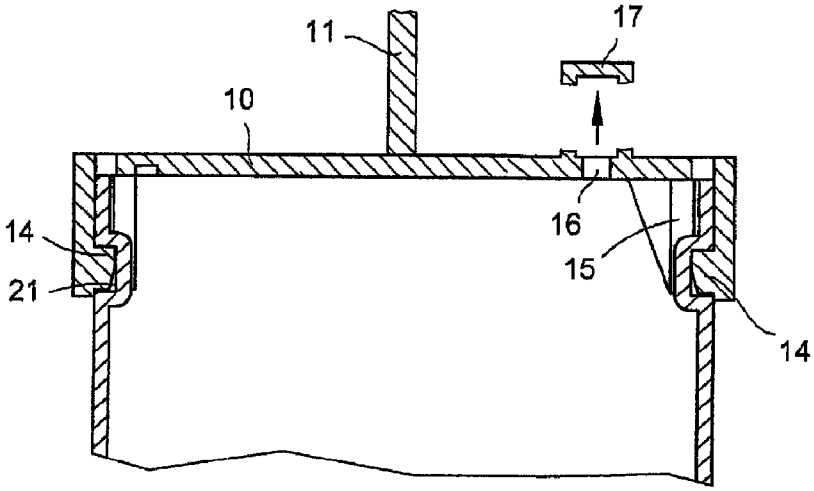
FIG. 3 is a schematic view demonstrating fixing of the hanging cover board member according to the present invention.

The present invention provides a secure hanging structure of tool case, which, as shown in FIGS. 1-3, comprises a cover board member 10 that is arranged as a design of enclosure cover and a package case 20 that receives and houses a tool or a small part or accessory therein, both together constituting a complete arrangement of secure hanging structure, wherein the cover board member 10 comprises an inverted U-shaped covering top to which a projecting hanging plate 11 is mounted, either in the form of an integrally formed structure or a separate and externally-attached structure, which is shown as an integrally formed structure in the drawings as an example for explanation. The plate forms in an upper portion thereof a hanging hole 12 and is connected to the top of the cover with a lower portion thereof, where an elongate through slot 13, as well as thin folding lines formed on opposite sides thereof in an inclined fashion, is formed in a central portion of the plate. The whole enclosing inside surface of the cover forms, at opposite side faces thereof, spaced, opposing, and inward projecting retention pawls 14 in multiplicity, which can be of an equally spaced arrangement, especially in a design of circular cover. Formed at an intermediate portion between spaced retention pawls 14 to be parallel to a side face of the cover is a projecting arrangement of positioning plate 15, which is spaced from the side face of by a distance substantially sufficient to receive a rim of a case opening of the package case 20 to fit therein. For improvement of support stiffness of positioning plate 15, the plate, which is of an inverted L-shape, may be additionally provided, at a central portion thereof, with a reinforcement rib to serve as an assisting design. The positioning plate 15 of one side has a plate edge that is separated from the board surface of the cover, at the connection therebetween, by an open slot 16 that extends along a circumference of L-shaped plate. Fixed framing bars 17 are provided above the slot opening for connection to realize positioning of the positioning plate 15. The positioning plate 15 at the opposite side of the cover board member 10 forms, on opposite sides thereof, open slots 18 opposing side faces of the cover board member 10 and extending to the bottom thereof. A fixed framing bar 17 is provided outside the slot opening at a lower end thereof for connection in order to properly maintain enclosure stiffness in closing the cover board member 10. In use, the hanging cover board member 10 is directly fit to and cover a top end of a package case 20 that is separated formed and has an opening rim of a complementary configuration so as to cooperate with recesses 21, which is recessed into the case or is alternately formed as open slots, formed in side walls of the enclosure opening rim of the case at locations corresponding to the retention pawls 14 formed on the inside surface of the cover board member 10 to achieve inter-engagement for combination and assembling. With the engagement by the positioning plates 15 that are located inward in a relative sense, the side walls of the opening rim of the case cannot be depressed from the outside to release the retention pawls 14 from the secured engagement position, so as to achieve the purposes of secure packaging, whereby the purposes of secure deposition and suspension for exhibition of the product received inside the package case 20 can be realized.

Figure 4:
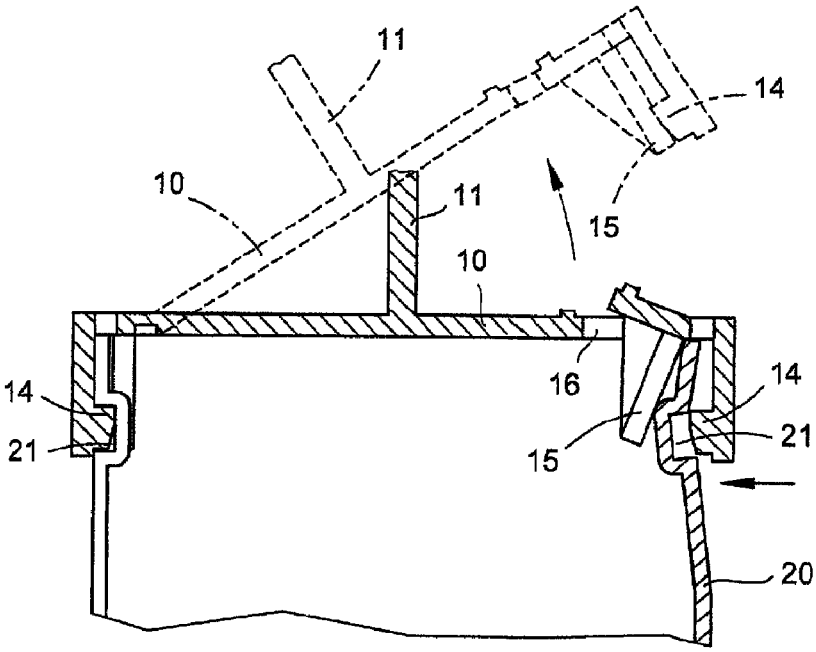
FIG. 4 is a schematic view demonstrating opening of the cover board member shown in FIG. 3.
Figure 5:
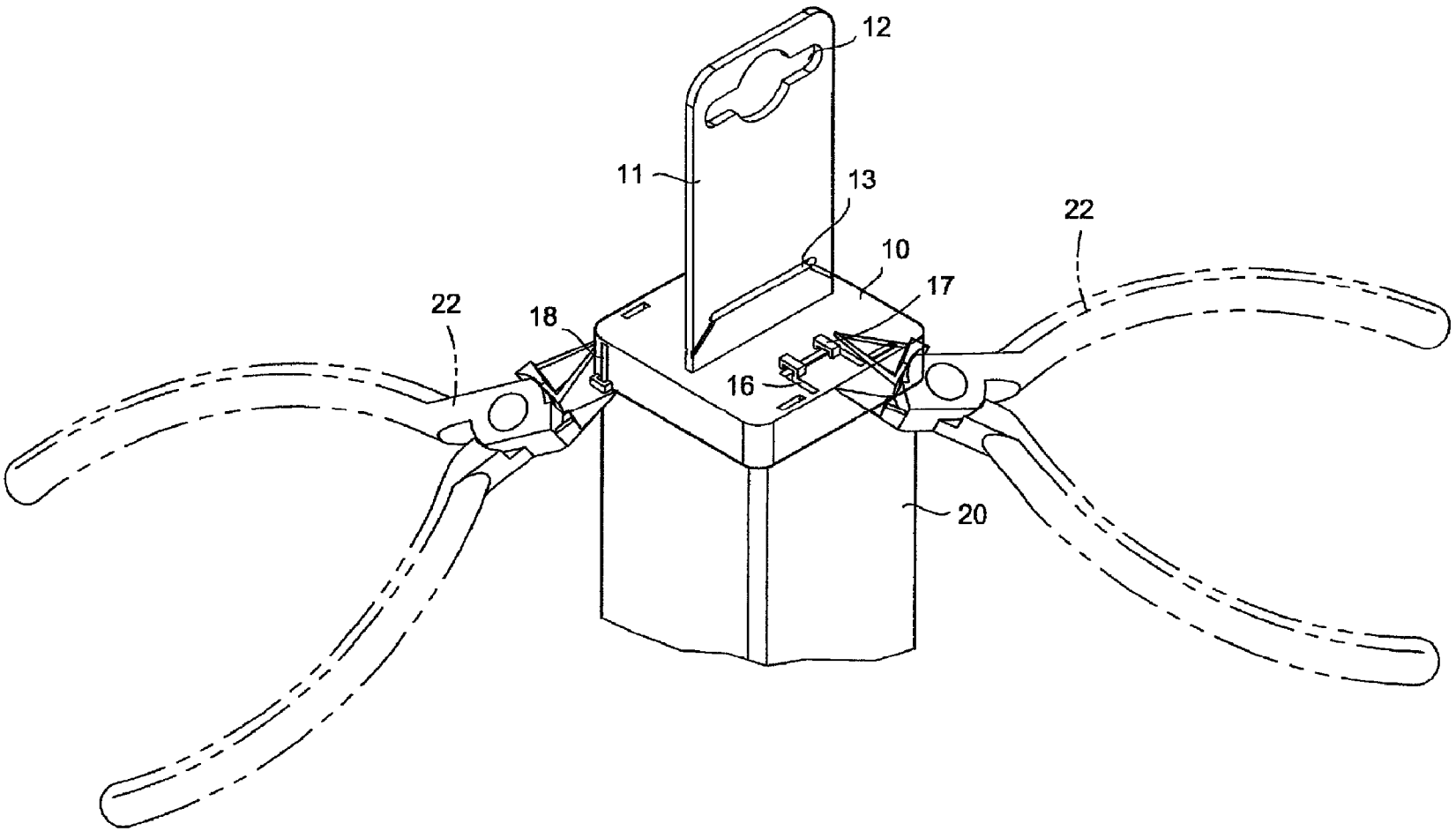
FIG. 5 is a schematic view demonstrating cutting off and opening the hanging cover board member according to the present invention.

In an application for suspension and exhibition of the case according to the present invention in a shopping mall, the receiving opening of the package case 20 is directly fit to and thus securely retained by the retention pawls 14, together with the supporting engagement by the positioning plates 15 at the inner side thereof, any attack of theft or unexpected crashing by a consumer that depresses the thin plate like opening rim of the case does not cause any potential risk of inward collapse to release the retention pawls 14 from retaining engagement with the recess 21, whereby true security for suspension exhibition can be achieved. A use, after purchasing, may uses a scissoring tool 22 to perform a cutting operation, as demonstrated in FIGS. 3-5, to cut off the framing bars 17 connected to the positioning plates 15, thereby removing the support of the positioning plate 15 to allow a user to easily compress the outside surface of the case at the corresponding location for inwardly depressing the thin plate like receiving opening rim of the case and thus releasing the retention pawls 14 from retaining engagement with the recess 21, so that the cover board member 10 can be readily removed and the tool or articles received in the case can be retrieved for use.

Figure 6:
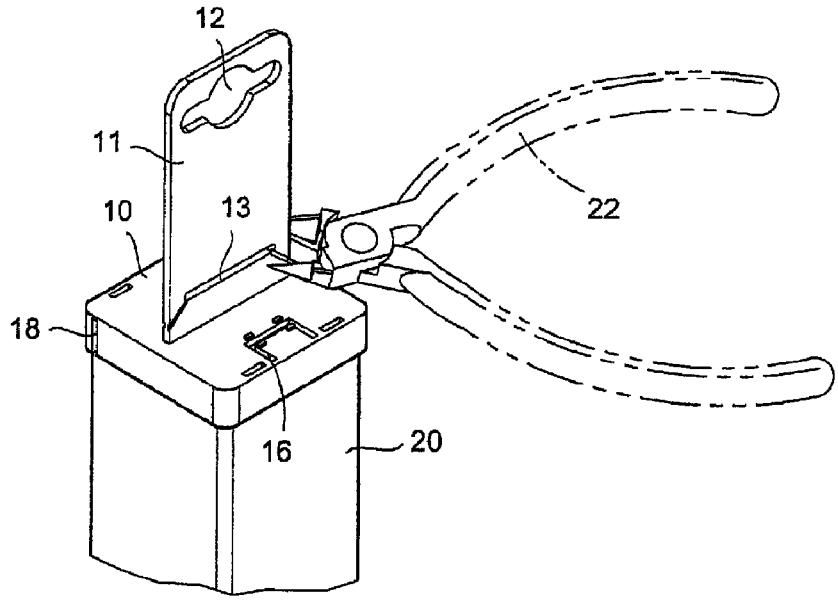
FIG. 6 is a schematic view demonstrating cutting off a hanging plate according to the present invention.
Figure 7:
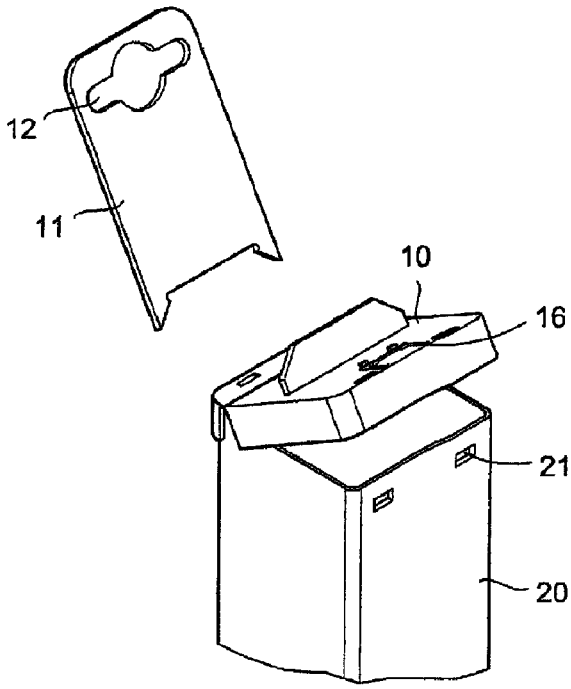
FIG. 7 is a schematic view demonstrating use of a cover according to the present invention after the hanging plate is cut off.

Alternatively, in view of the cover board member 10 according to the present invention, it is possible, at the same time of releasing the engagement, to apply a scissoring tool 22 to cut off the framing bars 17 that are provided at the lower ends of the open slots 18 formed on the side faces of the opposite side of the cover in order to allow the cover board member 10 to be operated in a lifting fashion. Since the retention pawls 14 on the end portions are still in engagement, the use of the package case 20 that uses a lid can be realized. Further, when the cover board member 10 is used as a lid for the use of the package case 20, it is possible to cut off the elongate hanging plate 11 extending from the top by using a scissoring tool 22, as shown in FIGS. 6 and 7, by shearing the inclined folding lines located on the two sides of the elongate slot 13 that is pre-formed in the lower portion, so as to substantially shorten the plate for easing hand holding in opening and significantly reducing the volume of the assembly thereby improving disposition of lining up. For the article received in the whole package case 20, with the enclosure and covering realized through the cover board member 10 according to the present invention, besides the efficacy of ensuring packaging security, the anti-theft retaining engagement and the arrangement of the hanging plate 11 provide the package case 20 with practical effectiveness of both security and suspension exhibition. In view of the hanging cover arrangement, easy molding and manufacturing can be realized and a design of multiple practical effectiveness is provided. This is a completely novel design for secure hanging member of the same kind available in the market and the practical effectiveness of secure suspension is of no match by the conventional hanging devices of the same kind.

In summary, the present invention provides a secure hanging structure of tool case, which comprises a completely encloseable cover board member, which is used in combination with a hanging plate for easy suspension and which provides true anti-theft effect through retention pawls formed on an inside surface of the cover board member and mutual positioning engagement with respect to positioning plates. Further, the easy cut-off arrangement of the connection framing bar allows the hanging cover board member to truly realize the functions of secure hanging and anti-theft for a package case.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A secure hanging structure of tool case, comprising a hanging plate and a package case for receiving and enclosing and characterized in that:

a cover board member has a top surface to which a projecting hanging plate is mounted and an enclosing inside surface that forms equally-spaced or spaced opposing projecting retention pawls at side faces thereof with a positioning plate being formed at an intermediate portion in the spacing in a projecting fashion to be parallel to a side face of the cover, wherein the positioning plate has a plate edge that is separated from a board surface of the cover by a open slot formed along a circumference at a connection therebetween, a fixed framing bar being provided above the slot opening for connection; and the package case has an enclosure opening rim that forms recesses that are inward recessed for retaining engagement at location corresponding to the retention pawls of the cover board member for mutual engagement for assembly, through positioning engagement with the positioning plates of the cover board member, the opening rim of the case realizes secure covering.

2. The secure hanging structure of tool case according to claim 1, wherein the positioning plates are of an inverted L-shaped cross-sectional configuration.

3. The secure hanging structure of tool case according to claim 1, wherein the hanging plate formed as an integral part or a separate externally attached part of the cover board member.

4. The secure hanging structure of tool case according to claim 1, wherein the hanging plate has an upper portion forming a hanging hole.

5. The secure hanging structure of tool case according to claim 1, wherein the hanging plate has a portion connected to the cover board member and forming in a central portion thereof an elongate through slot and two side inclined folding lines for scissoring.

6. The secure hanging structure of tool case according to claim 1, wherein the recess are in the form of through slots.

7. The secure hanging structure of tool case according to claim 1, wherein the cover board member forms open slots in side faces thereof at two sides of the positioning plate at one side of the cover board member, the open slots having lower ends that are each fixed and connected by a framing bar.

* * * * *